US011639253B2

(12) United States Patent
Swartz et al.

(10) Patent No.: US 11,639,253 B2
(45) Date of Patent: May 2, 2023

(54) MULTIFUNCTIONAL BOTTLE LID ASSEMBLY

(71) Applicant: Lifetime Brands, Inc., Garden City, NY (US)

(72) Inventors: John Roscoe Swartz, Ridgewood, NJ (US); Alex Geller, Brooklyn, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 0 days.

(21) Appl. No.: 17/350,573

(22) Filed: Jun. 17, 2021

(65) Prior Publication Data

US 2022/0402663 A1 Dec. 22, 2022

(51) Int. Cl.
*B65D 47/06* (2006.01)
*B65D 47/08* (2006.01)

(52) U.S. Cl.
CPC ..... *B65D 47/065* (2013.01); *B65D 47/0885* (2013.01)

(58) Field of Classification Search
CPC ..... A47G 19/2272; A47G 21/18; B65D 43/0225; B65D 47/065; B65D 47/0885
See application file for complete search history.

(56) References Cited

U.S. PATENT DOCUMENTS 2,844,267 A 7/1958 Petriccione
4,976,364 A 12/1990 Solomon
5,158,191 A 10/1992 Douglas et al.
5,244,113 A * 9/1993 Stymiest ..... B65D 47/0885 215/396
D626,837 S 11/2010 Meyers et al.
3,042,701 A1 10/2011 Raman et al.
8,365,941 B2 2/2013 Mayer
8,408,410 B2 4/2013 Raman
8,550,269 B2 10/2013 Lane
8,622,237 B2 1/2014 Choi et al.
8,689,989 B2 4/2014 Lane
D830,118 S 10/2018 Ksiazek et al.
(Continued)

FOREIGN PATENT DOCUMENTS

CN 209 634 978 U 11/2019
JP H09 183448 A1 7/1997

OTHER PUBLICATIONS

European Search Report from 22179504.0 dated Nov. 14, 2022, 28 pgs.

*Primary Examiner* — Vishal Pancholi
*Assistant Examiner* — Robert K Nichols II
(74) *Attorney, Agent, or Firm* — Tutunjian & Bitetto, P.C.

(57) ABSTRACT

A hydration bottle includes a fluid container and a lid assembly configured to be releasably engaged to the fluid container, the lid assembly having a first mouthpiece and a second mouthpiece independently accessible with respect to each other. The lid assembly includes a pivotal mount having two legs extending from a support member to form a generally U-shaped configuration, the support member defining a passage. The passage of the support member of the pivotal mount is configured to receive the first mouthpiece and has a cap fixedly disposed thereof. The second mouthpiece includes a pair of lateral projections on opposed ends thereof, the pair of lateral projections adapted to engage a pair of tapered flaps disposed on a base portion of the lid assembly.

20 Claims, 6 Drawing Sheets

(56) References Cited

U.S. PATENT DOCUMENTS

| | | | | |
|---|---|---|---|---|
| 10,159,368 | B2 * | 12/2018 | Lin | A47G 19/2266 |
| D856,065 | S | 8/2019 | Breit et al. | |
| 10,512,347 | B1 * | 12/2019 | Shepard | B65D 47/066 |
| D914,438 | S | 3/2021 | Breit et al. | |
| 2003/0168455 | A1 * | 9/2003 | Zettle | B65D 47/0895 220/714 |
| 2007/0029334 | A1 | 2/2007 | Bagley | |
| 2012/0018431 | A1 | 1/2012 | Wu | |
| 2016/0355305 | A1 | 12/2016 | Hoskins | |
| 2017/0129665 | A1 * | 5/2017 | Rolfes | B65D 47/0885 |
| 2019/0062006 | A1 | 2/2019 | Breit et al. | |
| 2019/0084734 | A1 | 3/2019 | Ni | |
| 2020/0317409 | A1 * | 10/2020 | Yu | B65D 47/0885 |
| 2021/0039845 | A1 | 2/2021 | Howard et al. | |

* cited by examiner

MULTIFUNCTIONAL BOTTLE LID ASSEMBLY

BACKGROUND

The present invention relates generally to hydration and fluid carrying devices, and more specifically, to a hydration bottle having dual openings independently operable and/or accessible with respect to each other.

Conventional hydration devices such as water bottles are useful for various purposes in activities such as athletic, outdoor, recreational, or other uses. Typically, water bottles are designed for a user to carry water, electrolytic fluid replacement drinks, or any type of liquid or, in some cases, powders or other materials. Conventionally, these bottles are formed from plastic and include a cap. Some conventional drink bottles include a threaded or other neck from which a user drinks fluid contained in the drink bottle after removal of the cap. Some conventional drink bottles include a spout, or nozzle, from which the drink fluid may be drawn from the drink bottle without removing the cap of the drink bottle. Conventional spouts include straws and rigid spouts having an outlet through which drink fluid may flow. Other conventional drink bottles require the cap to be completely removed to permit drink fluid to be accessed from the drink bottle.

SUMMARY

In accordance with an embodiment, a hydration bottle is provided. The hydration bottle includes a fluid container and a lid assembly configured to be releasably engaged to the fluid container, the lid assembly having a first mouthpiece and a second mouthpiece independently accessible with respect to each other.

In accordance with another embodiment, a lid assembly is provided. The lid assembly includes a base portion defining a circumferentially threaded configuration on an inner surface thereof, a first mouthpiece and a second mouthpiece disposed on the base portion, and a pivot mount having two legs extending from a support member to form a generally U-shaped configuration, wherein the support member defines a passage configured to receive the first mouthpiece.

In accordance with yet another embodiment, a drink bottle is provided. The drink bottle includes a fluid container and a lid assembly configured to be releasably engaged to the fluid container, the lid assembly having a first mouthpiece and a second mouthpiece wherein the first mouthpiece is a non-swiveling mouthpiece and the second mouthpiece is a swiveling mouthpiece.

It should be noted that the exemplary embodiments are described with reference to different subject-matters. In particular, some embodiments are described with reference to method type claims whereas other embodiments have been described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be described within this document.

These and other features and advantages will become apparent from the following detailed description of illustrative embodiments thereof, which is to be read in connection with the accompanying drawings.

BRIEF DESCRIPTION OF THE DRAWINGS

The invention will provide details in the following description of preferred embodiments with reference to the following figures wherein.

Throughout the drawings, same or similar reference numerals represent the same or similar elements.

DETAILED DESCRIPTION

Embodiments in accordance with the present invention provide for a hydration bottle having dual openings independently operable and/or accessible with respect to each other.

Personal beverage bottles are becoming ever more popular and have moved beyond the common beverage bottle packed with a school lunch or in a lunch box. Gyms are filled with members exercising, and many members bring their own beverage bottles for hydration. Hikers, bikers, walkers, commuters, tourists and many others carry beverage bottles as they go about their business. An increasingly common feature of the beverage bottles is a drink nozzle or spout that offers the ability to drink from the bottle without complete removal of the lid from the bottle.

The exemplary embodiments of the present invention introduce drink bottles and drink containers applicable to the hydration field, and are specifically applicable to portable bottles and similar containers from which users may selectively drink potable drink fluid. The hydration bottles of the exemplary embodiments of the present invention include a first opening or port or mouthpiece and a second opening or port or mouthpiece. The first mouthpiece is fixed on a base portion of a lid assembly, whereas the second mouthpiece is swivelable or movable or non-fixed. A pivotal mount or pedestal having a support member with two legs extending therefrom enables a user to selectively use either the first mouthpiece or the second mouthpiece. Stated differently, the pivotal mount enables independent operation and/or accessibility of the first and second mouthpieces.

It is to be understood that the present invention will be described in terms of a given illustrative architecture; however, other architectures, structures, substrate materials and process features and steps/blocks can be varied within the scope of the present invention. It should be noted that certain features cannot be shown in all figures for the sake of clarity.

This is not intended to be interpreted as a limitation of any particular embodiment, or illustration, or scope of the claims.

Figure 1:
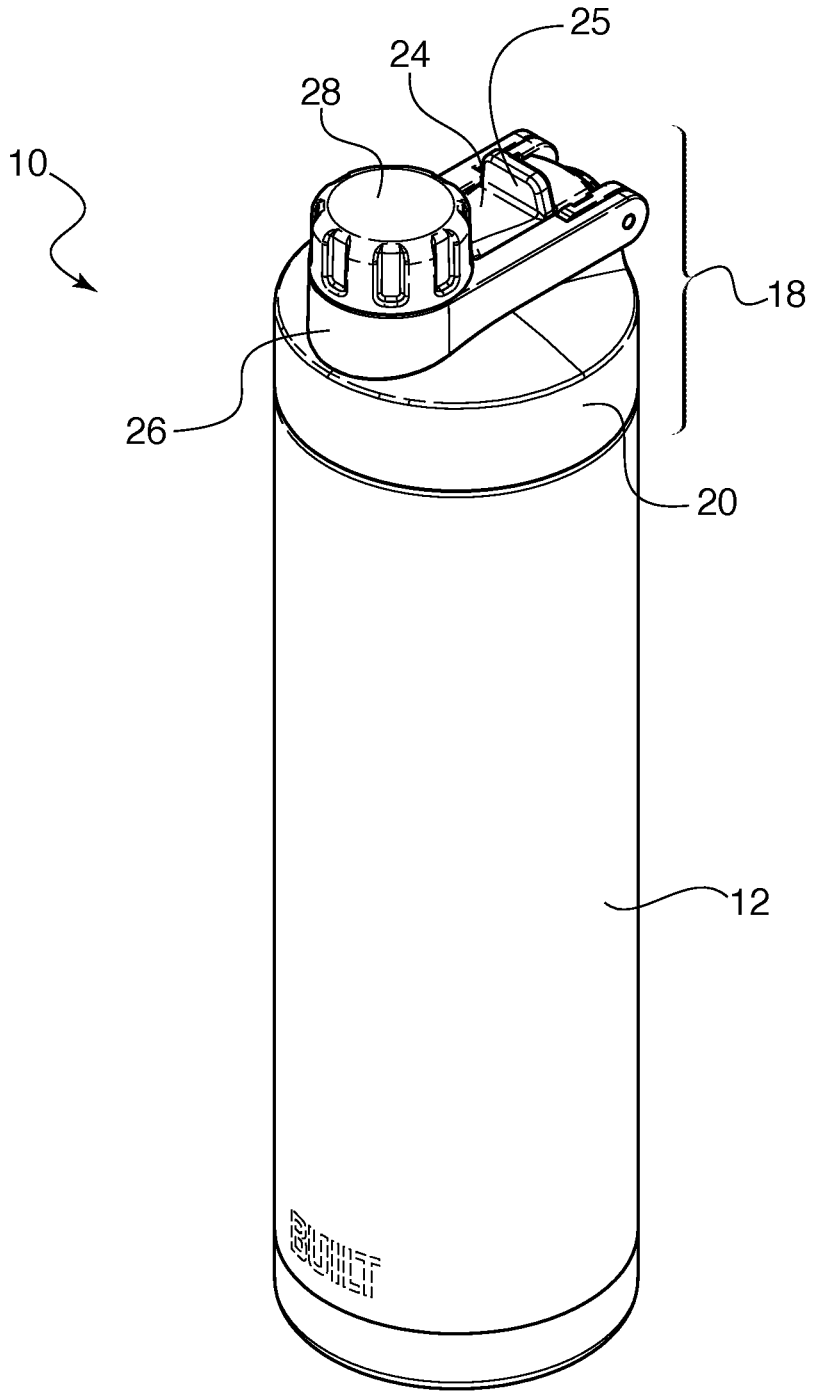
FIG. 1 illustrates a perspective view of a hydration bottle having dual discharge openings, in accordance with an embodiment of the present invention.

FIG. 1 illustrates a perspective view of a hydration bottle having dual discharge openings, in accordance with an embodiment of the present invention.

The hydration bottle 10 includes a bottle body 12 and a removable lid assembly 18. The hydration bottle 10 can also be referred to as a beverage bottle, a beverage container, a drink bottle, and/or a drink container. The bottle body 12 can also be referred to as a fluid container defining at least one chamber.

The lid assembly 18 includes a first mouthpiece 22 (FIG. 3) and a second mouthpiece 24 disposed over or on top of a base portion 20. The first mouthpiece 22 is enclosed within cap 28. The second mouthpiece 24 is in a closed position such that it is parallel to a top surface of the base portion 20. In the closed position, the opening 23 (FIG. 5) of the second mouthpiece remains inaccessible. The second mouthpiece 24 further includes a tab or projection 25 disposed thereof. The lid assembly 18 further includes a pivotal mount 26 that accommodates both the first and second mouthpieces 22, 24. The pivotal mount 26 can also be referred to as a base or pedestal or support structure.

Figure 6:
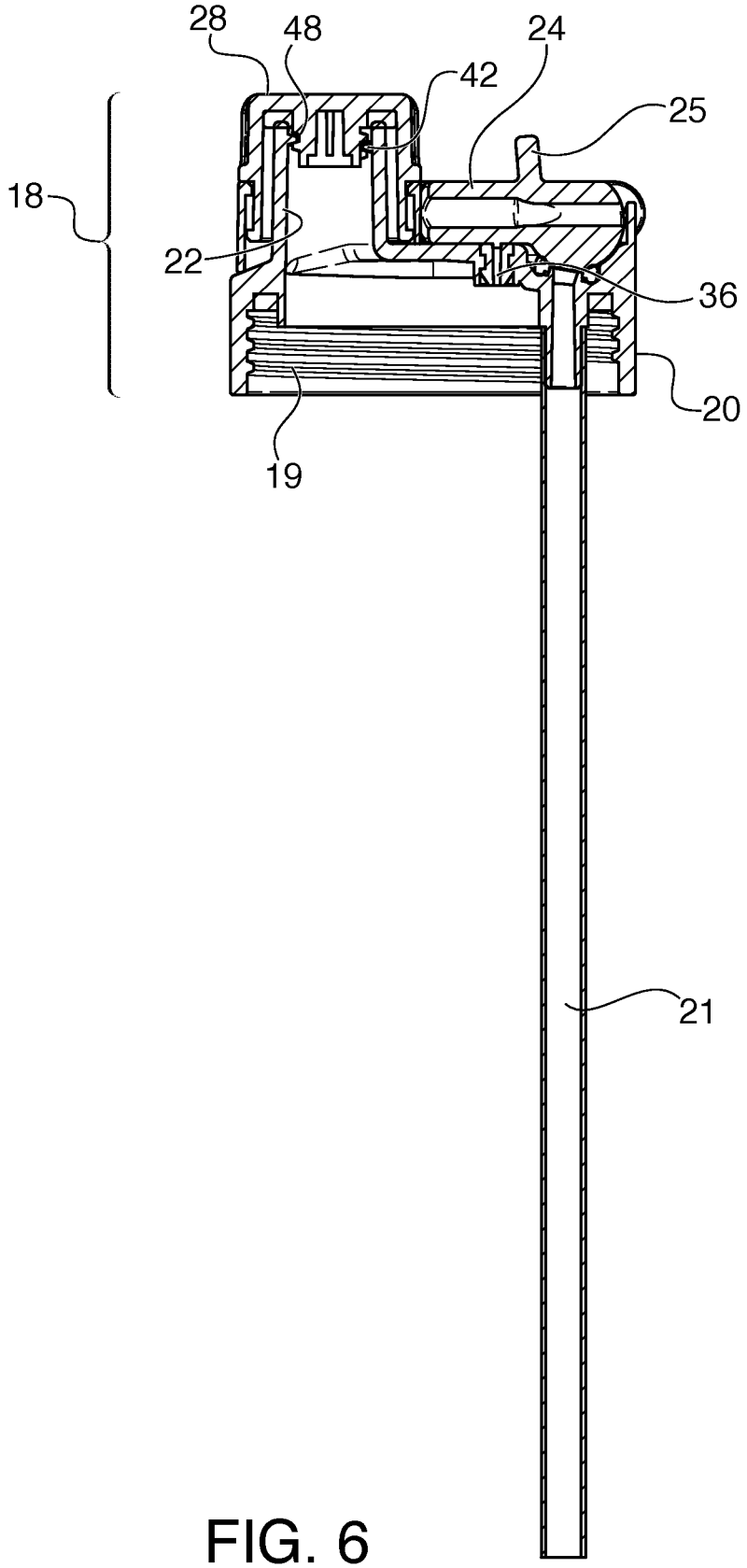
FIG. 6 illustrates a cross-sectional view of the removable lid assembly, in accordance with an embodiment of the present invention.

The lid assembly 18 is secured to the mouth of the bottle body 12 by a threaded connection 19 (FIG. 6). Threads are formed about the mouth of the bottle body 12 and cooperating threads are formed within the lid assembly 18 so that the lid assembly 18 may be threadably attached to and detached from the bottle body 12.

Bottle body 12 may be made, manufactured, molded (e.g., injection, cold, or the like), or otherwise formed using various materials, including, but not limited to plastic, low density plastic, high density plastic, polycarbonate, polycarbonate without Bisphenol-A (or other endocrine disrupting compounds), polyvinyl chloride ("PVC"), stainless steel, wood, aluminum, polyester, copolyester, or any other type of organic or synthetic materials, alloys, or composites. Bottle body 12 may be transparent for purposes of describing various features.

The bottle body 12 may be of any suitable material, including metal, plastic, glass, rubber and combinations thereof and may be insulated or un-insulated. Illustrative, non-exclusive examples of suitable sizes (i.e., capacities of drink fluid able to be received into the fluid container at one time) for fluid container 12 include 4 oz., 6 oz., 8 oz., 10 oz., 12 oz., 16 oz., 20 oz., 24 oz., 32 oz., 36 oz., 0.5 liters, 0.7 liters, 1 liter, 1.5 liters, 6-11 oz., 12-19 oz., 19-25 oz., 12-36 oz., 25-36 oz, and 10-70 oz. (with these illustrative examples referring to fluid ounces of drink fluid that may be poured in one filling into an empty fluid container). It is within the scope of the present disclosure that containers having different sizes, including sizes that are smaller than, larger than, or within the illustrative sizes and/or ranges presented above, may be used without departing from the scope of the present disclosure.

Moreover, bottle body 12 may be formed from any suitable material or combination of materials. Non-exclusive examples of factors that may be (but are not required to be) considered when selecting material(s) for the fluid container 12 include the durability of the material, the intended potable drink fluid, or types of drink fluids, that will be contained in the fluid container 12, the intended life, or period of use, of the hydration bottle 10, whether the fluid container 12 is intended to be refilled or otherwise reused, environmental concerns, whether the fluid container 12 is intended to resist being collapsed during use, whether the fluid container 12 is designed to permit a user to collapse the fluid container 12 inwardly when dispensing fluid therefrom, or to dispense drink fluid therefrom, whether the fluid container 12 is designed to be washed in a household dishwasher, etc. In some embodiments, it may be desirable for the material(s) to be selected so that the fluid container 12 will be transparent, or at least translucent, so that a user may see the contents of the fluid container 12, or at least the level of drink fluid within the fluid container 12, through the walls, or wall structure, of the fluid container 12.

Figure 2:
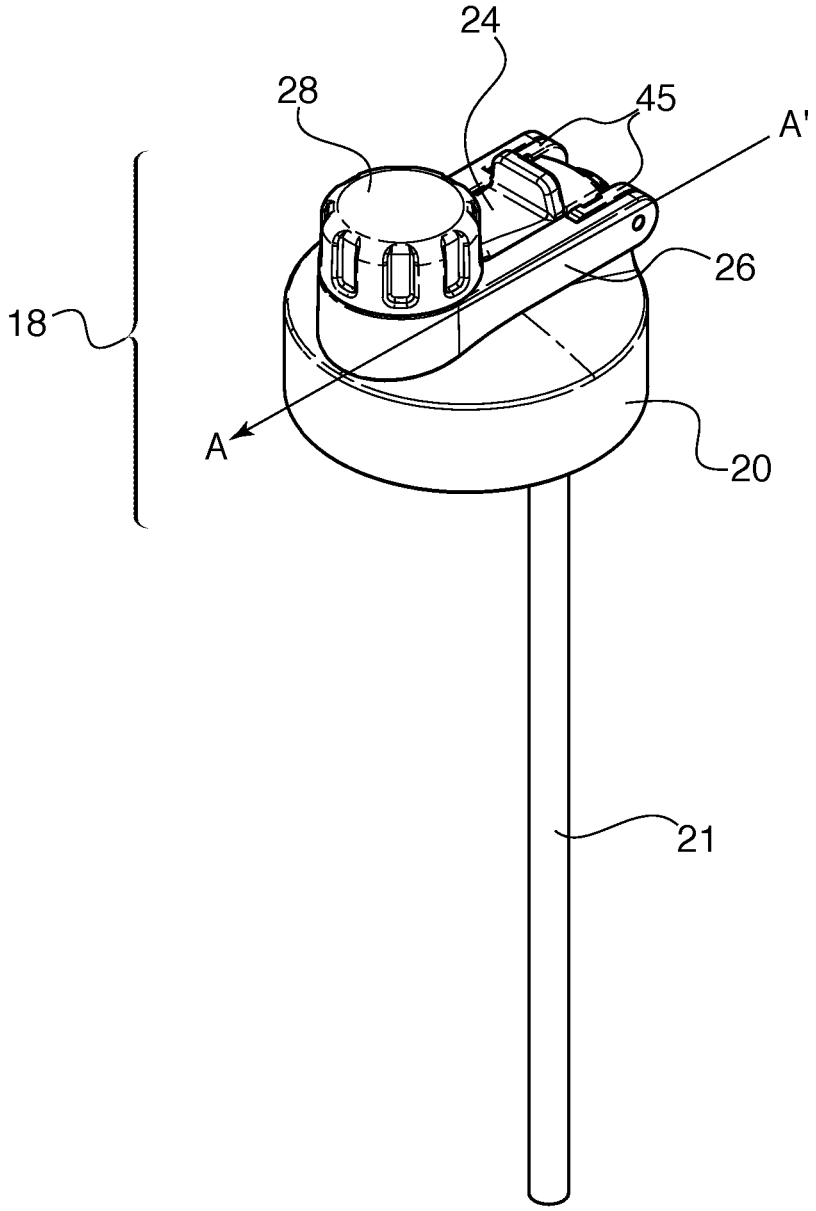
FIG. 2 illustrates a perspective view of the removable lid assembly of the hydration bottle of FIG. 1, in accordance with an embodiment of the present invention.

FIG. 2 illustrates a perspective view of the removable lid assembly of the hydration bottle of FIG. 1, in accordance with an embodiment of the present invention.

The removable lid assembly 18 can be connected to a straw 21. In one instance, the second mouthpiece 24 can be connected to the straw 21. The second mouthpiece 24, in a closed position, can be parallel to axis A-A' extending through the pivotal mount 26.

The pivotal mount 26 can have a substantially or generally U-shaped configuration. The pivotal mount 26 extends an entire length or diameter of the base portion 20. The pivotal mount 26 encompasses or encloses or surrounds the first mouthpiece 22 and the second mouthpiece 24 such that the first mouthpiece 22 is not visible or covered by cap 28, whereas the second mouthpiece 24 remains exposed. The pivotal mount 26 is formed over or on top of the base portion 20 of the lid assembly 18. The pivotal mount 26 engages flaps 45, as will be described in detail below with reference to FIG. 5.

Figure 3:
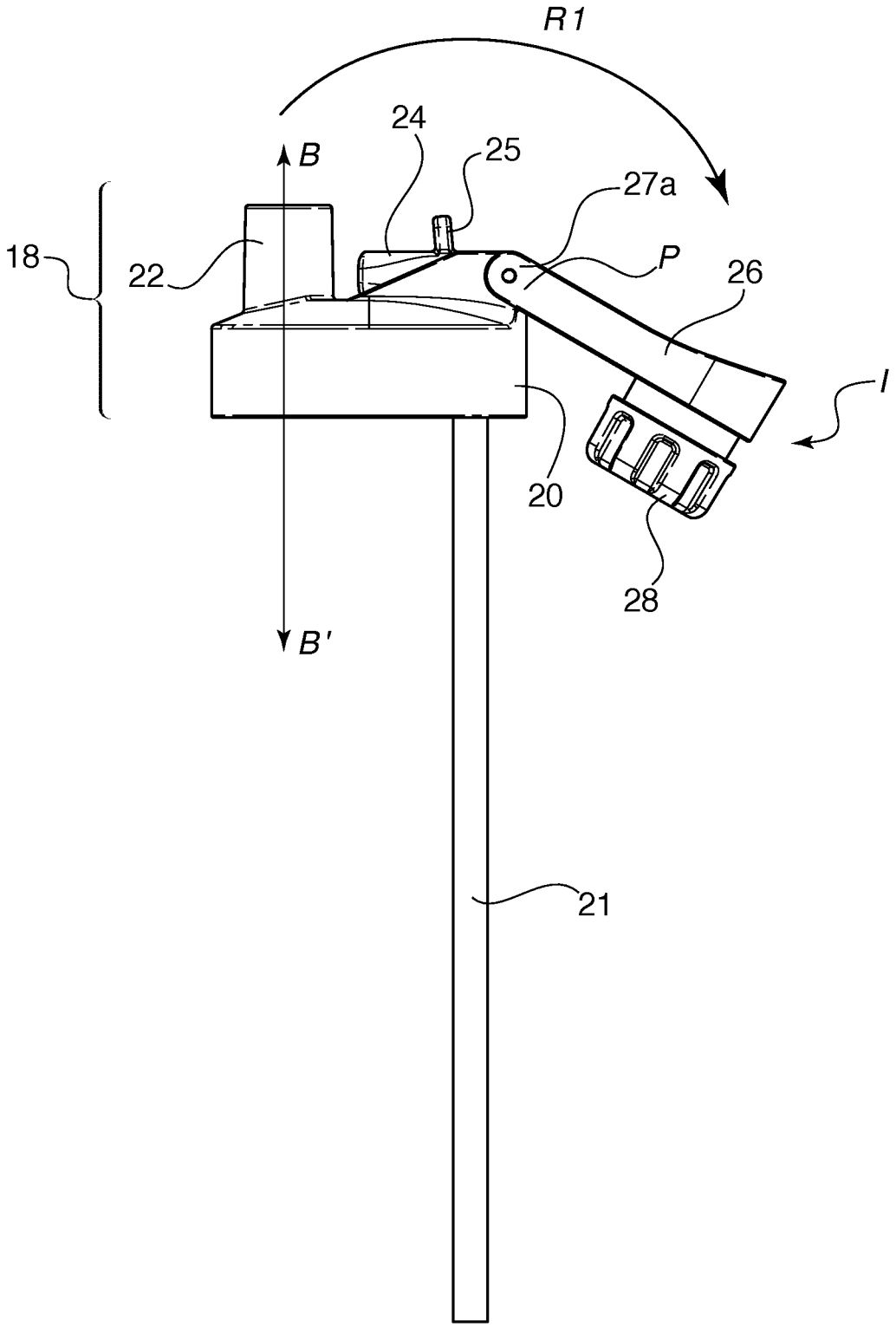
FIG. 3 illustrates a perspective side view of the removable lid assembly, where the first mouthpiece is exposed, in accordance with an embodiment of the present invention.

FIG. 3 illustrates a perspective side view of the removable lid assembly, where the first mouthpiece is exposed, in accordance with an embodiment of the present invention.

The pivotal mount 26 is opened in a flip motion "R1" (or swiveling motion) in order to expose the first mouthpiece 22. The pivotal mount 26 is pivoted about point "P." Point "P" is configured to receive pins 38 (FIG. 5) to secure the pivotal mount 26 to the lid assembly 18. The cap 28 remains fixedly attached to the pivotal mount 26 during the flip motion "R1." It is contemplated that the cap 28 remains fixedly attached to the pivotal mount 26 at all times.

The first mouthpiece 22 is fixed or non-swivelable. Thus, the first mouthpiece 22 remains perpendicular to axis B-B' at all times. The first mouthpiece 22 is a non-swiveling mouthpiece whereas the second mouthpiece 24 is a swiveling or movable mouthpiece. When the first mouthpiece 22 is exposed, the second mouthpiece 24 remains in a closed position. As a result, a person using the lid assembly 18 on the bottle body 12 (FIG. 1) would only access one mouthpiece or opening or port at a time. It is contemplated that the first and second mouthpieces 22, 24 are independently operable and/or independently accessible. Thus, the user either uses and/or accesses one mouthpiece or the other, not both simultaneously or concurrently.

It is noted that the pivotal mount 26 moves in a swiveling manner over the second mouthpiece 24. In other words, the support member 29 (FIG. 5) with the cap 28 extends directly over the second mouthpiece 24 such that it rests in the inverted position "I." In the inverted position "I," the cap 28 and the support member 29 extend beyond the outer periphery or outer perimeter of the base 20 of the lid assembly 18. Thus, flip motion "R1" is directly over the second mouthpiece 24. In this position, the straw 21 is not accessible as the second mouthpiece 24 remains in a closed position.

Figure 4:
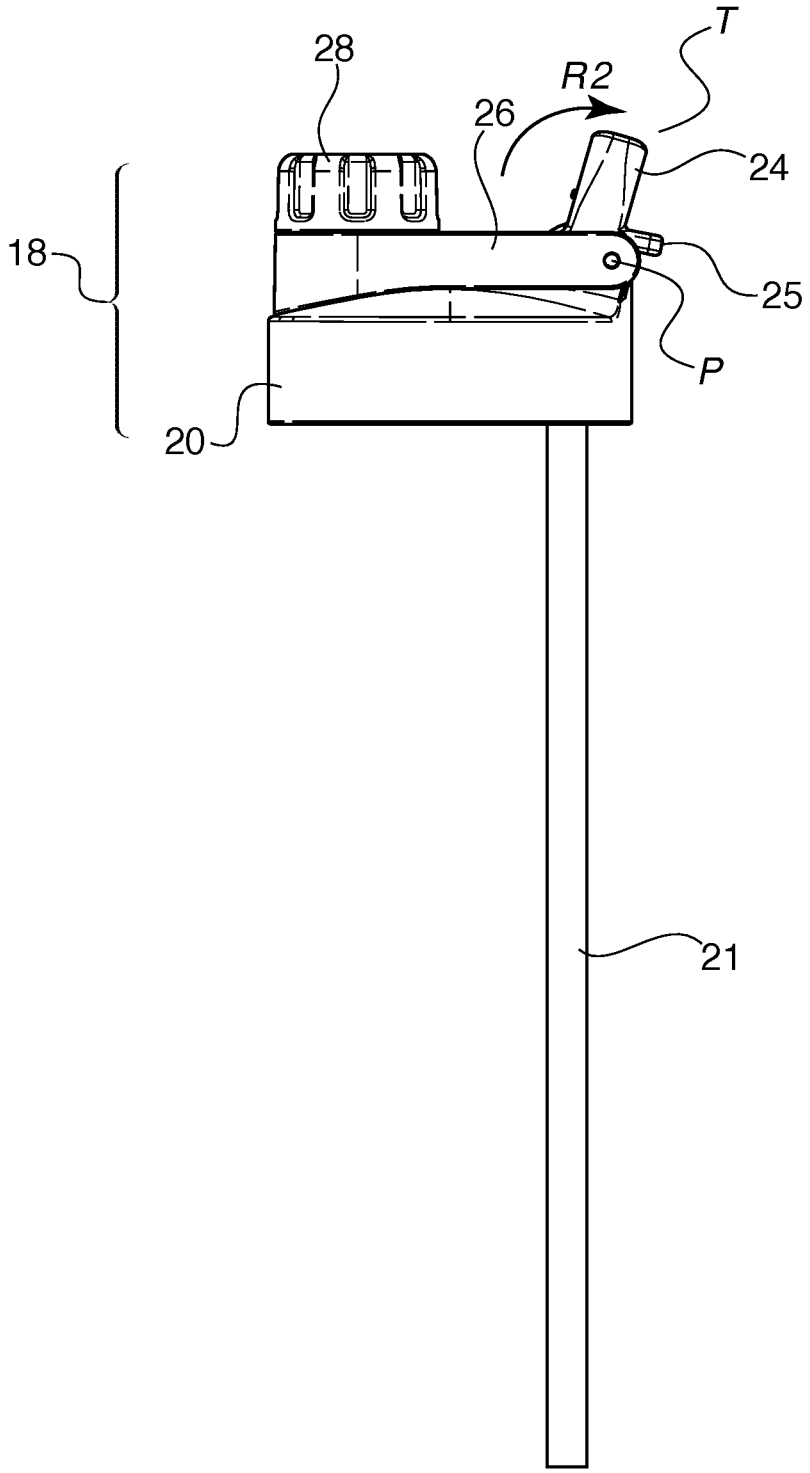
FIG. 4 illustrates a perspective side view of the removable lid assembly, where the second mouthpiece is exposed, in accordance with an embodiment of the present invention.

FIG. 4 illustrates a perspective side view of the removable lid assembly, where the second mouthpiece is exposed, in accordance with an embodiment of the present invention.

The pivotal mount 26 remains in a closed position, that is, the cap 28 of the pivotal mount 26 is positioned over the first mouthpiece 22 such that access to the first mouthpiece is prevented. Instead, the second mouthpiece 24 is flipped via flip motion "R2" to allow access to the person using the beverage bottle 10 (FIG. 1). The second mouthpiece 24 swivels to a position "T" which is the furthest position the second mouthpiece 24 can be moved to due to the tab 25 contacting the base portion 20. Thus, the tab 25 determines how far the second mouthpiece 24 can be swiveled in the rightward direction. The tab 25 extends beyond an outer periphery or outer perimeter of the base portion 20 of the lid assembly 18.

As a result, when the second mouthpiece 24 is exposed, the first mouthpiece 22 remains in a closed position. In fact, the first mouthpiece 22 is not visible due to the cap 28. As a result, a person using the lid assembly 18 on the bottle body 12 (FIG. 1) would only access one mouthpiece or opening or port at a time. It is contemplated that the first and second mouthpieces 22, 24 are independently operable and/or independently accessible. Thus, the user accesses and/or uses either one mouthpiece or the other, not both simultaneously or concurrently.

Therefore, in operation, in FIG. 3, the user flips the pivotal mount 26 to access the first mouthpiece 22, whereas, in operation, in FIG. 4, the user flips the second mouthpiece 24 to access the mouthpiece 24. Thus, when one port is open, the other remains closed, and vice versa. Moreover, the pivotal mount 26 enables the switching between the first and second mouthpieces 22, 24. For instance, when the pivotal mount 26 is in a first position (cap 28 over the first mouthpiece 22; FIG. 4), only the second mouthpiece 24 can be accessed. When the pivotal mount 26 is in a second position (pivoted in direction "R1"; FIG. 3), only the first mouthpiece 22 can be accessed. Thus, the first and second mouthpieces 22, 24 can be independently operated and/or accessed with respect to each other.

Figure 5:
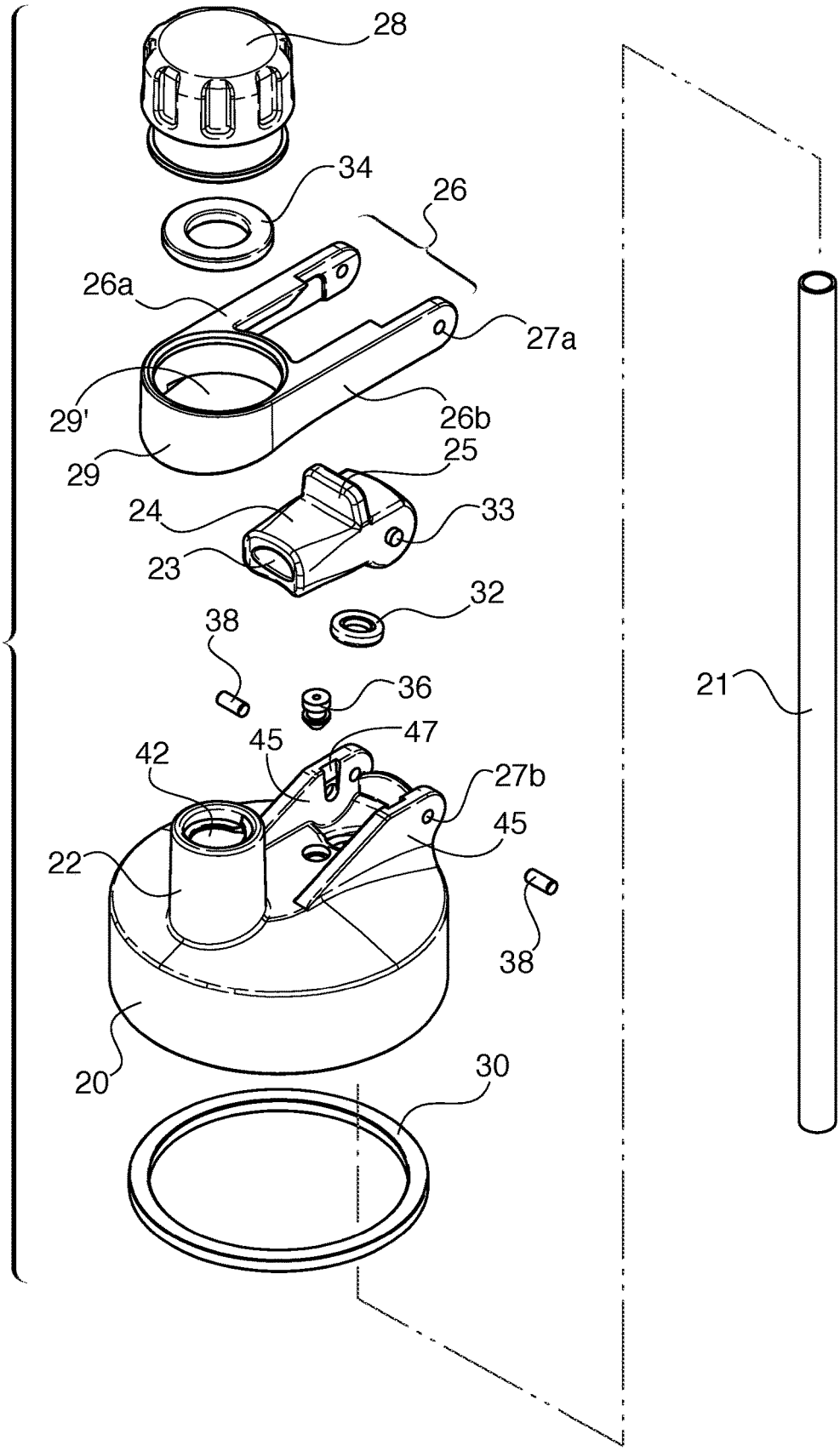
FIG. 5 illustrates an exploded perspective view of the removable lid assembly, in accordance with an embodiment of the present invention.

FIG. 5 illustrates an exploded perspective view of the removable lid assembly, in accordance with an embodiment of the present invention.

The exploded view clearly illustrates the mechanical components of the lid assembly 18 and their interrelations.

The pivotal mount 26 defines a support member 29 having a first leg 26*a* and a second leg 26*b* extending therefrom. The first leg 26*a* remains parallel to the second leg 26*b*. The support member 29 is circular and defines a passage 29'. The distal ends of the first and second legs 26*a*, 26*b* define openings or apertures 27*a*. The pivotal mount 26 defines a substantially or generally U-shaped configuration. A washer 34 is configured to enable secure attachment between the support member 29 of the pivotal mount 26 and the cap 28.

The second mouthpiece 24 includes a pair of lateral projections 33 on opposed ends thereof. The second mouthpiece 24 has an opening 23. The tab 25 of the second mouthpiece is further visualized. The tab 25 is vertically offset from the pair of lateral projections 33.

The first mouthpiece 22 includes an opening 42 and is fixedly coupled or molded to the top surface of the base portion 20. Adjacent the first mouthpiece 22 is a pair of flaps 45. The flaps 45 have a tapered configuration such that the tapered portion is closer to the first mouthpiece 22. A threaded valve 36 is received within an aperture defined between the flaps 45. An O-ring seal 32 can be configured to facilitate secure engagement between the second mouthpiece 24 and the threaded valve 36. The lateral projections 33 of the second mouthpiece 24 are configured to be received within recesses 47 formed on inner sidewalls of the flaps 45. The recesses 47 are defined in the non-tapered section of the flaps 45. The tapered portion of the flaps 45 commences directly adjacent the recesses 47.

The tapered flaps further include apertures 27*b*. The apertures 27*b* are defined at the non-tapered portion of the flaps 45. Stated differently, the apertures 27*b* are defined at the proximalmost end of the flaps 45. The apertures 27*b* are a pair of apertures configured to receive a pair of pins 38. Pins 38 are configured to couple the pivot mount 26 to the flaps 45 so that the second mouthpiece 24 is fixedly engaged to the base portion 20 adjacent the first mouthpiece 22. The pins 38 are received within the apertures 27*b* (of the flaps 45) and within the apertures 27*a* (of the pivot mount 26). Therefore, the pins 38 engage both apertures 27*b* and 27*a*.

Further, the pivotal mount 26 receives the first mouthpiece 22 within the passage 29' of the support member 29 and the legs 26*a*, 26*b* directly contact the outer surface or outer sidewalls of the flaps 45. As a result, the second mouthpiece 24 sits within or is confined within the boundaries set by the flaps 45. The second mouthpiece 24 does not directly contact the legs 26*a*, 26*b* of the pivotal mount 26. The flaps 45 separate the second mouthpiece 24 from the pivotal mount 26. Stated differently, the flaps 45 prevent the second mouthpiece 24 from directly contacting the legs 26*a*, 26*b* of the pivotal mount 26. It is contemplated that the sidewall of the cap 28 may contact the opening 23 of the second mouthpiece 24.

Additionally, a seal ring 30 can be positioned within the base 20 of the lid assembly 18 to facilitate engagement between the lid assembly 18 and the bottle body 12 of the beverage bottle 10 (FIG. 1).

A straw 21 can be releasably connected to the base portion 20 such that the straw 21 can be accessed via opening 23 of the second mouthpiece 24.

FIG. 6 illustrates a cross-sectional view of the removable lid assembly, in accordance with an embodiment of the present invention.

Lid assembly 18 may be joined to the bottle body 12 (FIG. 1) using various techniques including, but not limited to, continuous and non-continuous screw threads, adhesives, pressure-based coupling mechanisms (e.g., ridges), or others. For example, lid assembly 18 may be rotated to engage screw threads (not shown) disposed on bottle body 12 with screw thread channels or canals (hereafter "channels") 19 to create a seal that may be hermetic and watertight. In some examples, reference to screw thread channels may refer to a screw thread or set of screw threads that, when engaged with a corresponding screw thread or set of screw threads creates a seal between two elements providing, in some examples, an air-tight or water-tight (e.g., hermetic) seal.

The cross-sectional view further illustrates the first mouthpiece 22 and its positional relationship to the second mouthpiece 24. The opening 42 of the first mouthpiece is perpendicular to the opening of the second mouthpiece 24.

Additionally, threads 48 of the cap 28 are shown that are configured to securely cover the opening 42 of the first mouthpiece 22.

In other examples, beverage bottle 10 and the above-described elements may be varied in function, structure, shape, design, implementation, configuration, or other aspects without limitation to the descriptions provided.

In summary, a hydration bottle or beverage bottle is presented including dual openings or dual ports or dual mouthpieces. One mouthpiece is fixed (or non-swivelable) and the other mouthpiece is swivelable (e.g., can be actuated in a flip motion). The first mouthpiece is configured to be independently operable and/or independently accessible with respect to the second mouthpiece. In other words, the first and second mouthpieces cannot be accessed at the same time (concurrently or simultaneously). Thus, a user can access either the first mouthpiece or the second mouthpiece. Such operation is enabled by a pivotal mount or pedestal. The pivotal mount flips to an open position to allow access to the first mouthpiece and flips to a closed position to allow the second mouthpiece to be flipped open. The pivotal mount pivots about pins placed at a proximalmost end of tapered flaps. The tapered flaps are positioned directly between the second mouthpiece and the pivotal mount to prevent direct contact therebetween. The second mouthpiece rests within recesses formed on an inner surface of the tapered flaps. The first mouthpiece is vertically offset from the second mouthpiece. The first and second mouthpieces are placed or positioned or disposed on a base portion of the lid assembly. The pivotal mount has a substantially or generally U-shaped configuration shaped to facilitate independent access to the first and second mouthpieces.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

It should also be understood that the example embodiments disclosed and taught herein are susceptible to numerous and various modifications and alternative forms. Thus, the use of a singular term, such as, but not limited to, "a" and the like, is not intended as limiting of the number of items. Furthermore, the naming conventions for the various components, functions, parameters, thresholds, and other elements used herein are provided as examples, and can be given a different name or label. The use of the term "or" is not limited to exclusive "or" but can also mean "and/or".

Having described preferred embodiments, which serve to illustrate various concepts, structures and techniques that are the subject of this patent, it will now become apparent to those of ordinary skill in the art that other embodiments incorporating these concepts, structures and techniques may be used. Additionally, elements of different embodiments described herein may be combined to form other embodiments not specifically set forth above.

Accordingly, it is submitted that that scope of the patent should not be limited to the described embodiments but rather should be limited only by the spirit and scope of the following claims.

The invention claimed is:

1. A hydration bottle comprising:

a fluid container; and a lid assembly including a base portion configured to be releasably engaged to the fluid container, the lid assembly having a first mouthpiece and a second mouthpiece independently accessible with respect to each other, wherein the lid assembly includes a pivotal mount pivotable about an edge of the base portion, the pivotal mount having two legs extending from a support member defining a passage.

2. The hydration bottle of claim 1, wherein the two legs extending from the support member form a generally U-shaped configuration.

3. The hydration bottle of claim 2, wherein the passage of the support member of the pivotal mount is configured to receive the first mouthpiece.

4. The hydration bottle of claim 2, wherein the passage of the support member of the pivotal mount has a cap fixedly disposed thereof.

5. The hydration bottle of claim 2, wherein the pivotal mount pivots directly over the second mouthpiece to expose the first mouthpiece.

6. The hydration bottle of claim 2, wherein the second mouthpiece is positioned within the confines of the two legs of the pivotal mount.

7. The hydration bottle of claim 2, wherein the second mouthpiece includes a pair of lateral projections on opposed ends thereof.

8. The hydration bottle of claim 7, wherein the pair of lateral projections of the second mouthpiece are adapted to engage a pair of tapered flaps disposed on the base portion of the lid assembly.

9. The hydration bottle of claim 8, wherein an outer surface of the pair of tapered flaps directly contacts an inner surface of the two legs of the pivotal mount.

10. The hydration bottle of claim 9, wherein the pair of tapered flaps define apertures for receiving pins, the pins configured to fixedly attach the pair of tapered flaps to the pivotal mount.

11. The hydration bottle of claim 1, wherein the first mouthpiece is a non-swiveling mouthpiece and the second mouthpiece is a swiveling mouthpiece.

12. The hydration bottle of claim 11, wherein the second mouthpiece is connected to a straw extending within the fluid container.

13. A lid assembly comprising:

a base portion defining a circumferentially threaded configuration on an inner surface thereof;

a first mouthpiece and a second mouthpiece disposed on the base portion; and a pivotal mount having two legs extending from a support member defining a passage to form a generally U-shaped configuration, wherein the pivotal mount is pivotable about an edge of the base portion.

14. The lid assembly of claim 13, wherein the pivotal mount pivots directly over the second mouthpiece to expose the first mouthpiece.

15. The lid assembly of claim 13, wherein the second mouthpiece is positioned within the confines of the two legs of the pivotal mount.

16. The lid assembly of claim 13, wherein the second mouthpiece includes a pair of lateral projections on opposed ends thereof.

17. The lid assembly of claim 16, wherein the pair of lateral projections of the second mouthpiece are adapted to engage a pair of tapered flaps disposed on the base portion of the lid assembly.

18. The lid assembly of claim 17, wherein an outer surface of the pair of tapered flaps directly contacts an inner surface of the two legs of the pivotal mount.

19. The lid assembly of claim 18, wherein the pair of tapered flaps define apertures for receiving pins, the pins configured to fixedly attach the pair of tapered flaps to the pivotal mount.

20. A drink bottle comprising:

a fluid container; and a lid assembly including a base portion configured to be releasably engaged to the fluid container, the lid assembly having a first mouthpiece, a second mouthpiece, and a pivotal mount, wherein the pivotal mount extends along an entire diameter of the base portion and has two legs extending from a support member defining a passage.

* * * * *